United States Patent [19]

Walter

[11] Patent Number: 4,830,122

[45] Date of Patent: May 16, 1989

[54] FLOW PULSING APPARATUS WITH AXIALLY MOVABLE VALVE

[75] Inventor: Bruno H. Walter, Edmonton, Canada

[73] Assignee: Intech Oil Tools Ltd, Edmonton, Canada

[21] Appl. No.: 46,621

[22] Filed: May 6, 1987

Related U.S. Application Data

[63] Continuation-in-part of Ser. No. 8,963, Jan. 30, 1987, which is a continuation-in-part of Ser. No. 626,121, Jun. 29, 1984, abandoned.

[30] Foreign Application Priority Data

Jul. 8, 1983 [CA] Canada ..... 432054

[51] Int. Cl.[4] ..... E21B 4/02

[52] U.S. Cl. ..... 175/106; 175/232; 175/317

[58] Field of Search ..... 175/38, 105, 106, 232, 175/293, 296, 298, 297, 234, 317; 367/84, 85; 166/177

[56] References Cited

U.S. PATENT DOCUMENTS

| | | | |
|---|---|---|---|
| 701,391 | 6/1902 | Pruszkowski . | |
| 2,287,157 | 6/1942 | Wolff . | |
| 2,743,083 | 4/1956 | Zublin . | |
| 2,750,154 | 6/1956 | Boice | 175/106 X |
| 2,780,438 | 2/1957 | Bielstein . | |
| 3,096,833 | 7/1963 | Bodine . | |
| 3,105,560 | 10/1963 | Zublin . | |
| 3,194,325 | 7/1965 | Gianelloni | 175/107 X |
| 3,415,330 | 12/1968 | Bouyoucos . | |
| 3,416,613 | 12/1968 | Henderson . | |
| 3,441,094 | 4/1969 | Galle et al. . | |
| 3,568,783 | 3/1971 | Chenoweth . | |
| 3,768,576 | 10/1973 | Martini . | |
| 3,807,512 | 4/1974 | Pogonowski et al. . | |
| 4,434,863 | 3/1984 | Garrett . | |

*Primary Examiner*—Jerome W. Massie, IV
*Assistant Examiner*—David J. Bagnell
*Attorney, Agent, or Firm*—Robert M. Phipps

[57] ABSTRACT

Flow pulsing apparatus is adapted to be connected in a drill string above a drill bit. The apparatus includes a housing providing a passage for a flow of drilling fluid toward the bit. A turbine in the housing is rotated about an axis by the flow of drilling fluid. A valve is operated by the turbine to periodically restrict the flow through the passage to create pulsations in the flow and a cyclical water hammer effect to vibrate the housing and the drill bit during use. A cam is provided for effecting reciprocation of the valve along the axis of rotation of the turbine to effect the periodic restriction of flow.

20 Claims, 8 Drawing Sheets

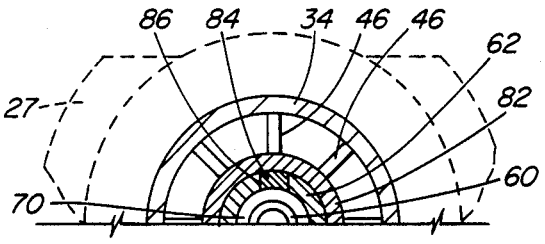
FIG. 6
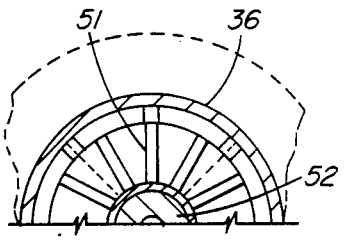
FIG. 7
FIG. 8
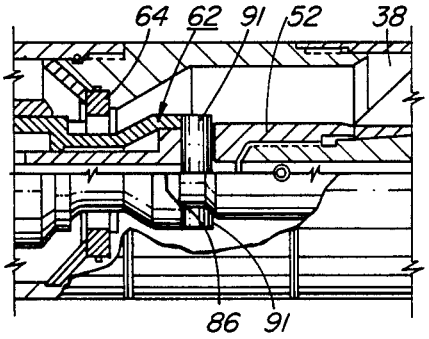
FIG. 10
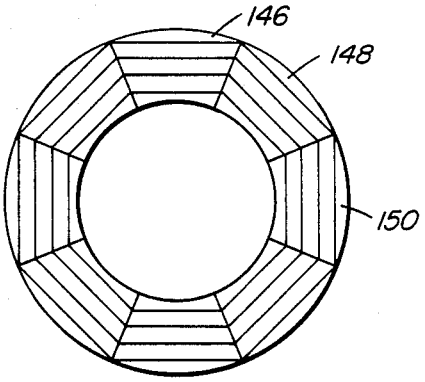
FIG. 11
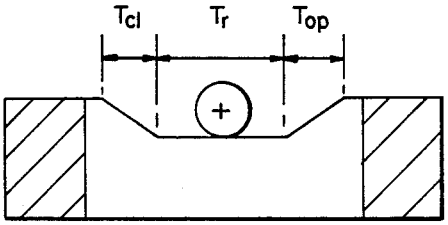

FLOW PULSING APPARATUS WITH AXIALLY MOVABLE VALVE

CROSS-REFERENCE TO RELATED APPLICATIONS

This is a continuation-in-part of my copending U.S. application Ser. No. 008,963 filed Jan. 30th, 1987 which in turn is a continuation-in-part of my copending U.S. application Ser. No. 626,121 filed June 29th, 1984 now abandoned, which was refiled as U.S. application Ser. No. 027,128 on Mar. 16, 1987, now abandoned.

BACKGROUND OF THE INVENTION

In the drilling of deep wells such as oil and gas wells, it is common practise to drill utilizing the rotary drilling method. A suitably constructed derrick suspends the block and hook arrangement, together with a swivel, drill pipe, drill collars, other suitable drilling tools, for example reamers, shock tools, etc. with a drill bit being located at the extreme bottom end of this assembly which is commonly called the drill string.

The drill string is rotated from the surface by the kelly which is rotated by a rotary table. During the course of the drilling operation, drilling fluid, often called drilling mud, is pumped downwardly through the hollow drill string. This drilling mud is pumped by relatively large capacity mud pumps. At the drill bit this mud cleans the rolling cones of the drill bit, removes or clears away the rock chips from the cutting surface and lifts and carries such rock chips upwardly along the well bore to the surface.

In more recent years, around 1948, the openings in the drill bit allowing escape of drilling mud were equipped with jets to provide a high velocity fluid flow near the bit. The result of this was that the penetration rate or effectiveness of the drilling increased dramatically. As a result of this almost all drill bits presently used are equipped with jets thereby to take advantage of this increased efficiency. It is worthwhile to note that between 45–65% of all hydraulic power output from the mud pump is being used to accelerate the drilling fluid or mud in the drill bit jet with this high velocity flow energy ultimately being partially converted to pressure energy with the chips being lifted upwardly from the bottom of the hole and carried to the surface as previously described.

As is well known in the art, a rock bit drills by forming successive small craters in the rock face as it is contacted by the individual bit teeth. Once the bit tooth has formed a crater, the next problem is the removal of the chips from the crater. As is well known in the art, depending upon the type of formation being drilled, and the shape of the crater thus produced, certain crater types require much more assistance from the drilling fluid to effect proper chip removal than do other types of craters. For a further discussion of this see "Full Scale Laboratory Drilling Tests" by Terra-Tek Inc., performed under contract Ey-76c-024098 for the U.S. Department of Energy.

The effect of drill bit weight on penetration rate is also well known. If adequate cleaning of the rock chips from the rock face is effected, doubling of the bit weight will double the penetration rate, i.e. the penetration rate will be directly proportional to the bit weight. However, if inadequate cleaning takes place, further increases in bit weight will not cause corresponding increases in drilling rate owing to the fact that formation chips which are not cleared away are being reground thus wasting energy. If this situation occurs, one solution is to increase the pressure of the drilling fluid thereby hopefully to clear away the formation chips in which event a further increase in bit weight will cause a corresponding increase in drilling rate. Again, at this increased drilling rate, a situation can again be reached wherein inadequate cleaning is taking place at the rock face and further increases in bit weight will not significantly affect the drilling rate and, again, the only solution here is to again increase the drilling fluid pumping pressure thereby hopefully to properly clear the formation chips from the rock face to avoid regrinding of same. Those skilled in the art will appreciate that bit weight and drilling fluid pressure must be increased in conjunction with one another. An increase in drilling fluid pressure will not, in itself, usually effect any change in drilling rate in harder formations; fluid pressure and drill bit weight must be varied in conjunction with one another to achieve the most efficient result. For a further discussion of the effect of rotary drilling hydraulics on penetration rate, reference may be had to standard texts on the subject.

It should also be noted that in softer formations, the bit weight that can be used effectively is limited by the amount of fluid cleaning available below the bit. In very soft formations the hydraulic action of the drilling fluid may do a significant amount of the removal work.

In an effort to increase the drilling rate, the prior art has provided vibrating devices known as mud hammers which cause a striker hammer to repeatedly apply sharp blows to an anvil, which sharp blows are transmitted through the drill bit to the teeth of the rolling cones. This has been found to increase the drilling rate significantly; the disadvantage however is that the bit life is significantly reduced. In a deep well, it is well known that it takes a considerable length of time to remove and replace a worn out bit and hence in using this type of conventional mud hammer equipment the increased drilling rate made possible is offset to a significant degree by the reduction in bit life.

One proposal for cyclically interrupting flow through a drill stem is disclosed in U.S. Pat. No. 2,780,438 issued Feb. 5, 1957. This patent proposes the use of a rotary valve member actuated by a spiral rotary valve actuator. Axially disposed co-operating passages are provided in the valve structure and thrust bearings take up axially oriented loads on the rotary valve member. Disadvantages of this proposal include the fact that the axially oriented passages are prone to blockage by debris. The high shock forces on the rotary valve member would tend to rapidly destroy the thrust bearings supporting the rotary valve. The overall arrangement would be very inefficient in providing fluctuating forces on the drill bit. The free telescoping movement of the housing above the rotary valve would destroy most of the desired water hammer effect and would appear to eliminate most of the pressure drop below the bit considering that the apparatus is acting in a closed system.

Another prior art flow pulsing arrangement is shown in the Zublin U.S. Pat. No. 2,743,083 issued Apr. 24, 1956. This patent shows several embodiments of an invention. In all of these embodiments, however, the arrangement is such that pressure pulses above the rotor and consequent pressure drops below the rotor act on almost the whole projected area of the rotor. High axial forces on the rotor bearings result thus materially shortening the bearing life. Furthermore, the valving arrangements provided are prone to jamming due to debris in the drilling fluid and if sufficient clearance is provided to alleviate jamming problems the structural configuration of the valve makes it difficult to achieve a meaningful level of pressure build-up.

My above-noted copending U.S. pat. applications Ser. Nos. 008963 and 626,121 (disclosures of which are incorporated herein by reference hereto) disclose improved forms of flow pulsing apparatus including a rotor having blades which is adapted to rotate in response to the flow of drilling fluid through the tool housing. A rotary valve forms part of the rotor and alternately restricts and opens the fluid flow passages thereby to create cyclical pressure variations. The flow passages comprise radially arranged port means in a valve section of the housing with the rotary valve means being arranged to rotate in close co-operating relationship to the port means to alternately open and close the radial ports during rotation.

Because of the fact that the drilling fluid typically contains a substantial portion of gritty material of varying size as well as other forms of debris such as sawdust and wood chips, and since it is not practical to attempt to screen or filter all of this material out of the drilling fluid, all of the above-described rotary valve arrangements are prone to jamming due to debris binding in the valve surfaces. Accordingly, there is a requirement that a degree of clearance be maintained between the valve surfaces and in my above-noted copending applications various improvements have been incorporated thereby to allow the radial clearances between the valving surfaces to be kept as small as possible while at the same time avoiding jamming under ordinary circumstances. It should be kept in mind, of course, that in order to achieve the maximum water hammer effect, the clearances should be kept as small as possible thereby to achieve the maximum possible conversion of the flow energy of the drilling fluid into dynamic pressure energy to produce the optimum water hammer effect. The structures described in my copending applications above require a minimum radial clearance in order to avoid binding and jamming. Hence, it can readily be seen that the total "leakage" area when the valve is "closed" will be equal to the clearance dimension multiplied by the total distance around the valve ports. Since there is a need to keep the total leakage area relatively small, it follows that the total distance around the valve ports must be kept reasonably small as well, resulting in much smaller than optimum port holes which in turn restrict the flow unduly even when the valve is fully open thus creating a substantial pressure drop across the open valve. This restriction of the flow through the fully open valve reduces the overall operating efficiency of the system for reasons which will be readily apparent to those skilled in the art.

Another disadvantage associated with rotary valve flow pulsating arrangements is that the timing or frequency of the fluctuation is strictly governed by the angular velocity of the rotor. Another disadvantage is that the shape of the pressure pulse curve cannot be easily varied or changed to better suit conditions.

SUMMARY OF THE INVENTION

The present invention provides improved flow pulsing apparatus adapted to be connected in a drill string above a drill bit and includes a housing providing a passage for a flow of the drilling fluid toward the bit. A turbine means is located in the housing and it is rotated during use about an axis by the flow of drilling fluid. A novel valve arrangement operated by the turbine means periodically restricts the flow through the passage to create pulsations in the flow and a cyclical water hammer effect to vibrate the housing and the drill bit during use. This valve means is reciprocated in response to the rotation of the turbine means to effect the periodic restriction of the flow as opposed to being rotated as in the other arrangements described above.

As a further feature of the invention cam means are provided for effecting the reciprocation of the valve means in response to rotation of the turbine means. The cam means preferably comprises an annular cam surrounding the axis of rotation of the turbine with cam follower means engaging the annular cam with relative rotation occurring between the follower means and the cam on rotation of the turbine to effect the reciprocation of the valve. The valve means includes a valve member which is mounted for reciprocation along the axis of rotation of the turbine. The axis of rotation, when the flow pulsing apparatus is located in the drill string, extends longitudinally of the drill string in a generally vertical orientation.

The valve member is preferably arranged such that during use it is bathed in drilling fluid so that the resulting pressure forces on the valve member substantially balance and cancel each other out, i.e. the valve member is essentially hydraulically neutral.

The valve structure preferably includes an annular ring fixed to the housing and surrounding the axis of rotation. The above-noted valve member is arranged such that an annular flow passage is defined between itself and this ring. The valve member is mounted for reciprocation toward and away from the annular ring such that the area of the annular flow passage varies from a maxiumum to a minimum.

In one embodiment of the invention a reciprocal valve member is secured against rotation while the annular cam and cam follower are arranged to interact between the turbine means and the valve member to effect reciprocation of the latter on rotation of the turbine.

In another version of the flow pulsing apparatus, both the turbine means and the valve member are fixed together for both rotary and reciprocating motion. In other words, during operation, with the cam follower in engagement with the annular cam and with relative rotation therebetween, the turbine and fixed valve member rotates and at the same time reciprocate to provide for fluctuation in the area of the annular flow passage as described above.

By utilizing the reciprocating valve structure described and claimed herein, a maximum restriction of the flow area can be achieved thus enabling maximum conversion of flow energy to dynamic pressure energy thus achieving a maximum pressure pulse or water hammer effect. At the same time this novel valving arrangement is capable of providing a large fluid flow area when the valve is open thus reducing head losses in the valve full open position and thus in turn allowing increased throughput of drilling fluid thus increasing overall drilling efficiency.

Since the preferred form of the invention provides a valve member that is essentially hydraulically balanced or neutral with no substantial fluid pressure forces thereon which would impede its movement, a highly efficient operation can be achieved. The reciprocating valve member is not nearly as prone to seizure by virtue of entrapped particles and debris as compared with relatively rotatable valving surfaces as described previously.

The cam arrangement noted above permits timing and frequency to be varied without being strictly dependent on angular velocity as before and moreover the shape of the cam can be varied as desired to achieve the desired shape of the pressure pulses being produced.

The above-noted annular ring portion of the valve structure can be mounted for easy removal and replacement from a differently sized ring thereby allowing the flow pulsing apparatus to be tuned for a different total flow volume.

The cam follower can be arranged to apply a non-symmetrical force to the movable valve member thus inducing a degree of lateral vibration which assists in self-cleaning of the valve. However, a symmetrical follower arrangement is also provided for when circumstances dictate.

The reciprocating valve member, as noted above, is resistant to the possibility of seizing due to particles as compared with rotational valve arrangements especially when the high degree of restriction (otherwise known as ratio of restriction) is taken into account, i.e. when the reciprocating valves' ability to achieve maximum closure and maximum water hammer effect, is taken into account. However, in the event that binding does occur, the mechanical arrangement can be such that the valve member simply stays open until the particle is washed away. A degree of purposely induced vibration can assist in cleaning. The reciprocating action of the valve actually tends to push troublesome particles through the valve opening and the valve surfaces can be provided with relatively sharp edges which can assist in cutting through certain types of particles and debris.

The operating life of the tool in terms of its wearing ability is also enhanced by virtue of the fact that the reciprocating valve member is essentially hydraulically neutral and hence does not transfer any resultant unbalanced hydraulic forces to the moving assembly. Certain of the prior art arrangements, as noted previously, are subject to large unbalanced hydraulic forces during operation thus materially shortening their lives.

The turbine assembly is preferably mounted on self-cleaning sleeve bearings which have a very substantial clearance allowing vibration of the rotary parts relative thereto in order to induce movement of drilling fluid into and out of these bearings. The bearings should be made of an extremely hard material such as tungsten carbide. The bearings are devoid of any seals so that the drilling fluid can move freely in and out. It has been found that this arrangement provides a relatively long operating life and does away with the problems associated with prior art conventional bearings which were prone to seal damage, contamination of lubricant by grit and rapid bearing wear.

The flow pulsing apparatus of the present invention can be advantageously combined with a shock tool as described hereinafter. A flow pulsing apparatus may also be combined with an integral blade stabilizer or reamer. These and other features including relationships concerning the ratio of restriction to ensure pulsating flow, relationships concerning lower and upper usable pulsation frequencies as well as the shape of the pressure pulse will be described hereinafter.

Further features of the invention and the advantages associated with same will be apparent to those skilled in the art from the following description of preferred embodiments of the invention when read in conjunction with the accompanying drawings.

BRIEF DESCRIPTION OF THE VIEWS OF DRAWINGS

Figure 5A:
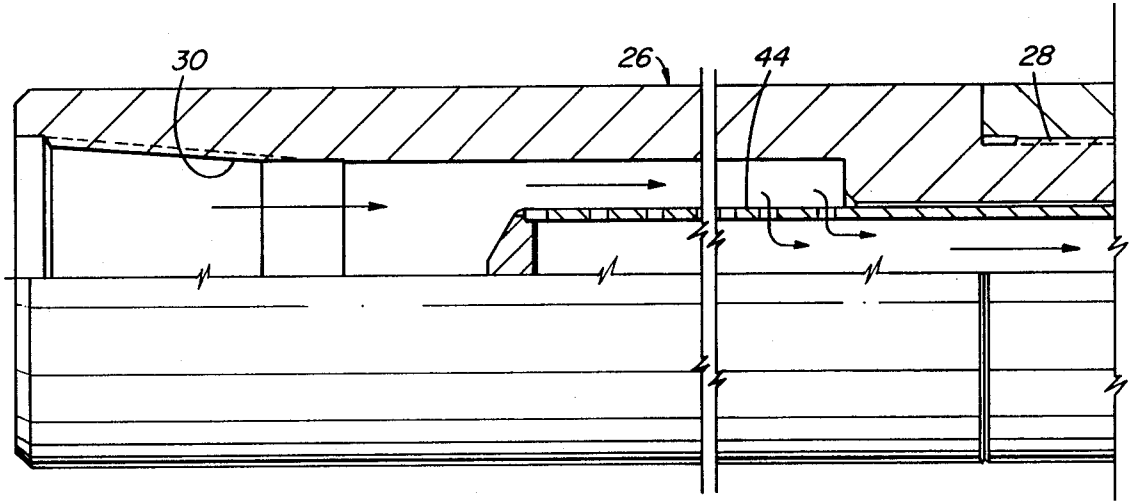
FIG. 5 (comprising parts 5A, 5B and 5C) is a longitudinal half section of apparatus for producing a pulsating flow of drilling fluid in accordance with one embodiment of the invention.
Figure 5B:
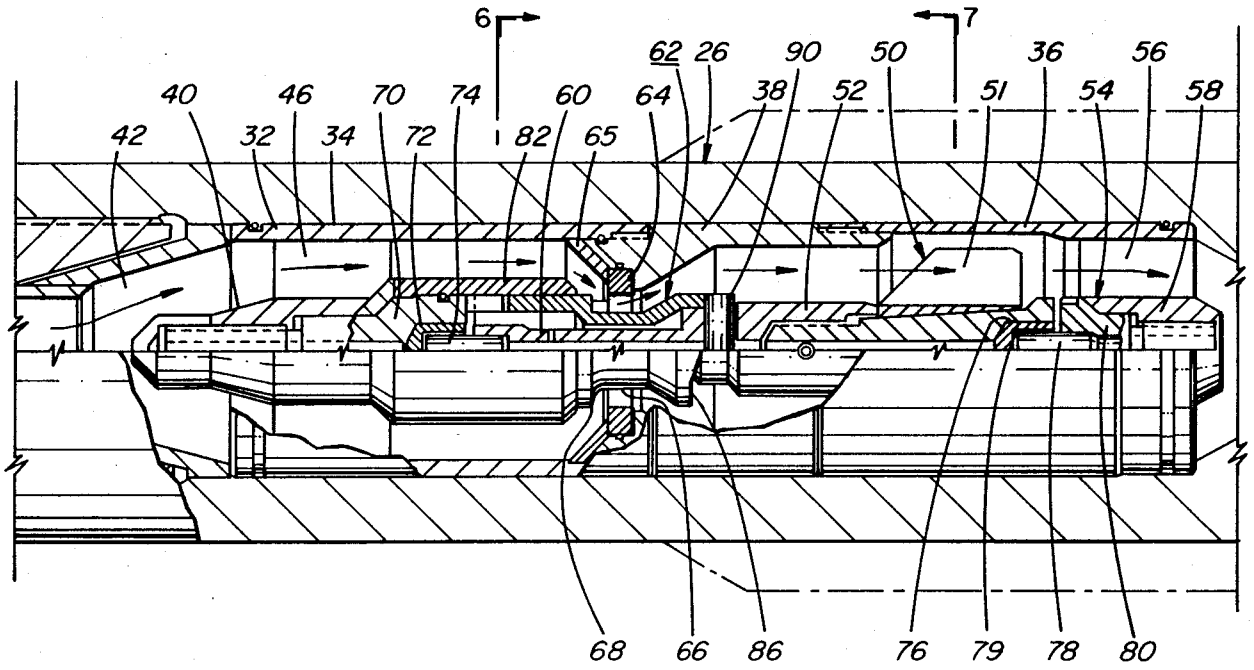
Figure 5C:
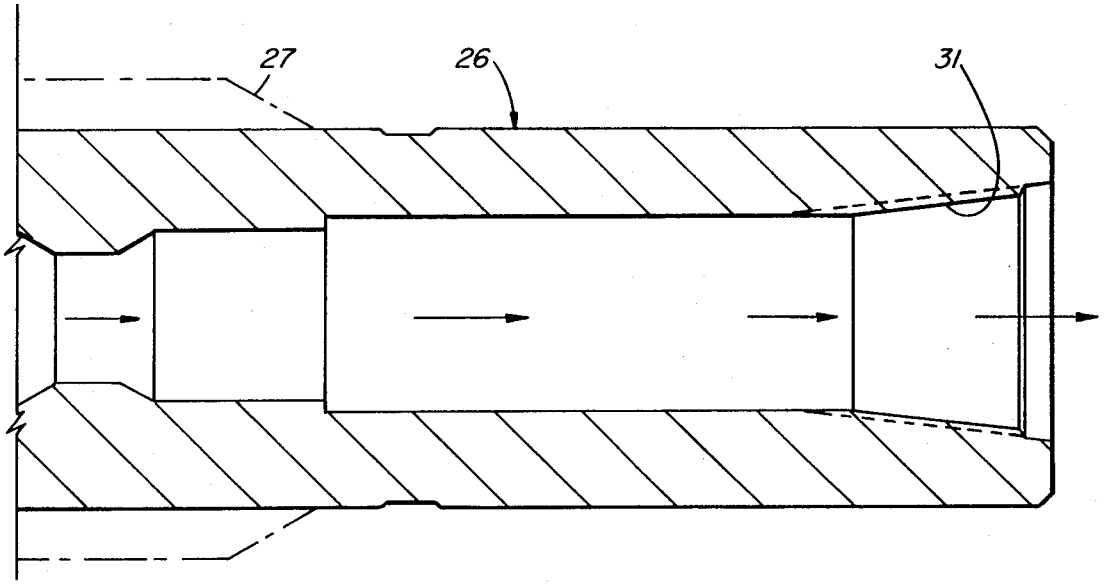
Figure 9:
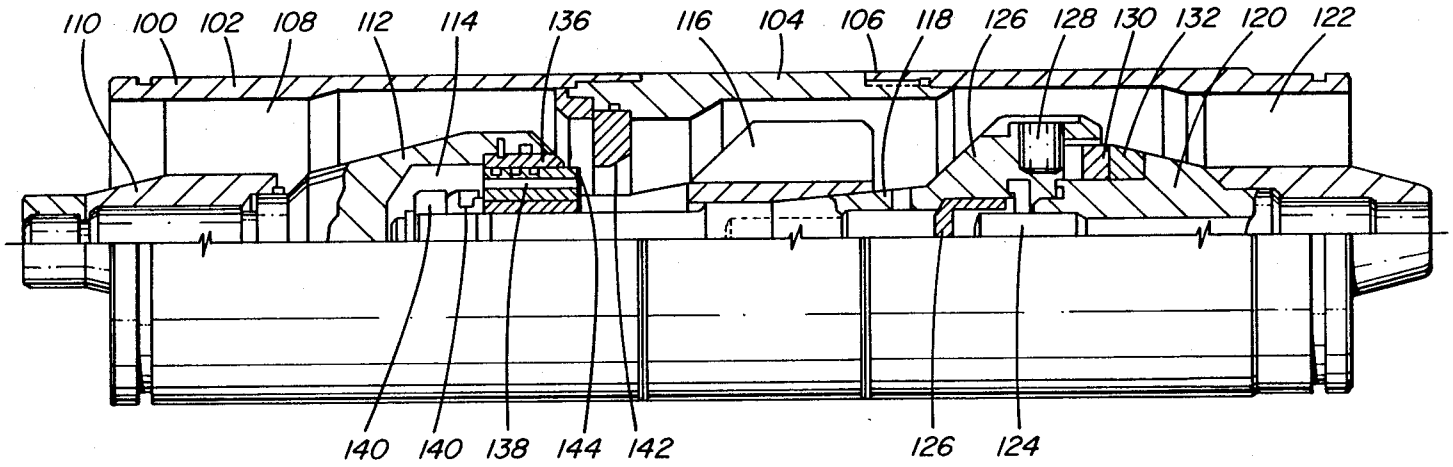
Figure 12:
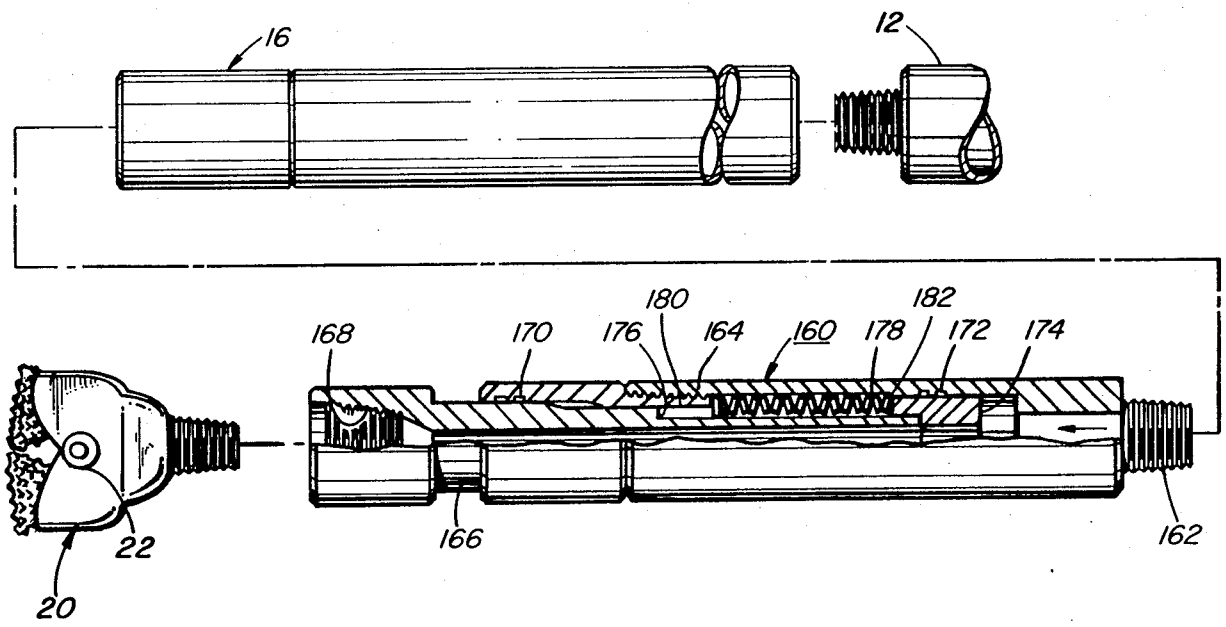
Figure 13:
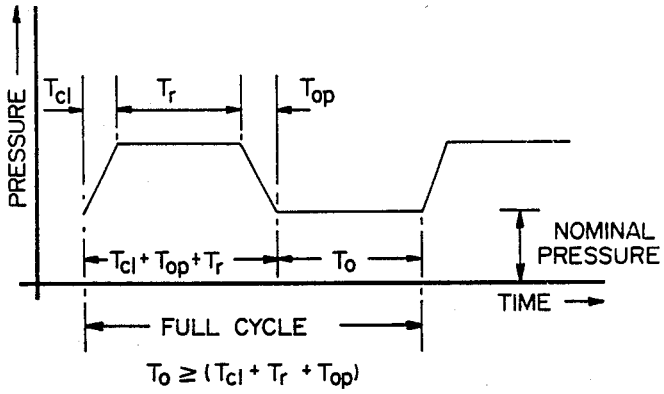
Figure 14:
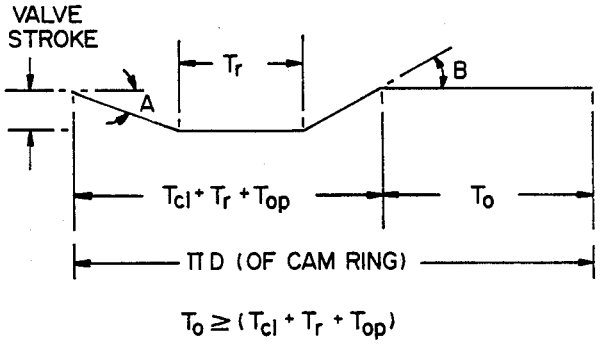

FIGS. 6 and 7 are cross-section views taken along lines 6—6 and 7—7 respectively of FIG. 5;

FIG. 8 is a fragmentary half section view of a flow pulsing apparatus very similar to that shown in FIG. 5 but with a modified cam arrangement;

FIG. 9 is a longitudinal half section view of a flow pulsing apparatus in accordance with another embodiment of the invention;

FIGS. 10 and 11 are plan and cross-section views respectively of typical annular cam arrangements for the flow pulsing apparatus;

FIG. 12 is an exploded view of apparatus in accordance with the invention incorporating a shock tool which is interposed between the drill bit and the flow pulsing apparatus;

FIG. 13 is a graph illustrating pressure fluctuations with time;

FIG. 14 is a graph illustrating the design of the cam; and

Figure 15:
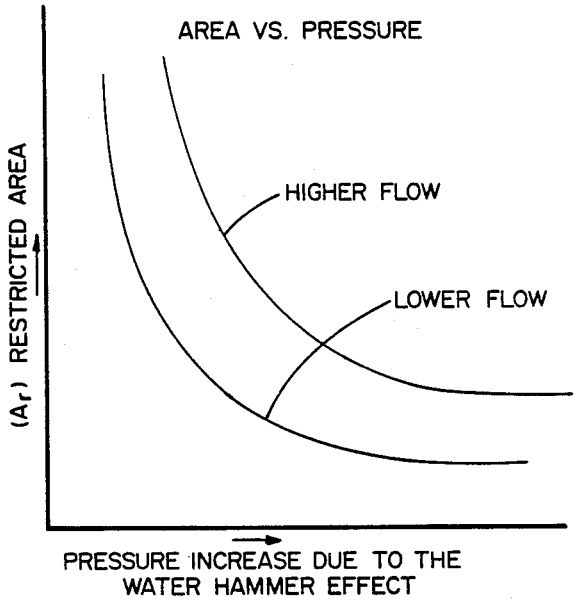

FIG. 15 is a graph relating flow area restriction with raise in pressure for differing fluid flow rates.

DESCRIPTION OF THE PREFERRED EMBODIMENTS

Figure 1:
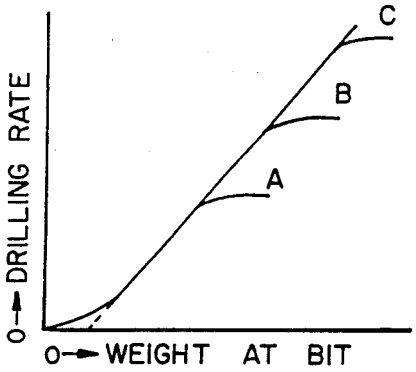
FIG. 1 is a graph illustrating the relationship between drilling rate and bit weight and illustrating the effect that increased cleaning has on drilling rate.

Reference will be had firstly to FIG. 1. As noted previously the effect of bit weight on penetration rate is well known. With adequate cleaning, penetration rate is directly proportional to bit weight. There are some limitations depending of course upon the type of formation being drilled. There is also, in any particular situation, a maximum upper limit to the magnitude of the weight which the bit can withstand.

With reference to FIG. 1, it will be seen that drilling rate is generally proportional to bit weight up to point A where drilling rate drops off rapidly owing to inadequate cleaning which means that formation chips are being reground. From point A, increased cleaning resulted in a proportional increase in drilling rate up to point B where, again, inadequate cleaning was in evidence with a consequent fall off in drilling rate. Again, by increasing the cleaning effect, drilling rate once again became proportional to bit weight up to point C where again, a fall off in drilling rate is in evidence.

FIG. 1 thus demonstrates clearly the importance of effective hole bottom cleaning in obtaining an adequate drilling rate.

It is noted that FIG. 1 has been described mainly in relation to the drilling of harder formations. In softer formations, where the hydraulic action of the drilling fluid does at least part of the work, the relationships shown in FIG. 1 would still apply, although for somewhat different reasons, as those skilled in the art will appreciate.

Figure 2:
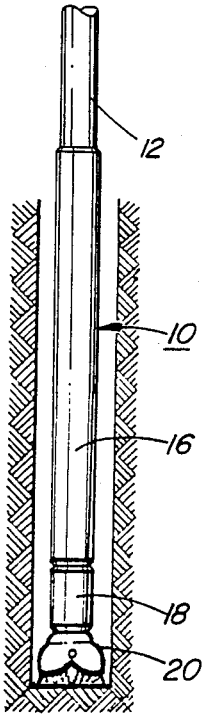
FIG. 2 is a longitudinal section at the bottom of a well bore illustrating apparatus according to the invention connected in the drill string immediately above the drill bit.
Figure 4:
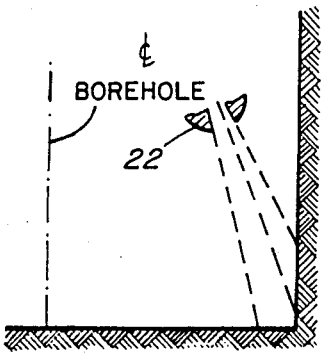
FIG. 4 is a diagrammatic view of the bottom end of the well bore illustrating a jet of drilling fluid emitted toward the wall and bottom of the bore hole.

Referring now to FIG. 2, there is shown in cross section the lower end portion of a bore hole within which the lower end of a drill string 10 is disposed, such drill string including sections of hollow drill pipe connected together in the usual fashion and adapted to carry drilling fluid downwardly from drill pumps (not shown) located at the surface. The drill string is driven in rotation by the usual surface mounted equipment also not shown. Attached to the lower end of the drill collar 12 via the usual tapered screw thread arrangement is a drilling fluid flow pulsing apparatus 16 in accordance with the invention. To the lower end of the flow pulsing apparatus is connected a relatively short connecting sub 18 which, in turn, is connected via the usual screw threads to a drill bit 20 of conventional design having the usual rolling cone cutters and being equipped with a plurality of cleaning jets suitably positioned to apply streams of drilling fluid on to those regions where they have been found to be most effective in removing chips from the bottom of the well bore. One of such cleaning jets 22 is diagrammatically illustrated in FIG. 4 (the remainder of the drill bit not being shown) thereby to illustrate the manner in which the jet of drilling fluid is directed against the side and bottom portions of the well bore during a drilling operation. The location and arrangement of the jet openings on the drill bit 20 need not be described further since they are not, in themselves, a part of the present invention but may be constructed and arranged in an entirely conventional manner.

Figure 3:
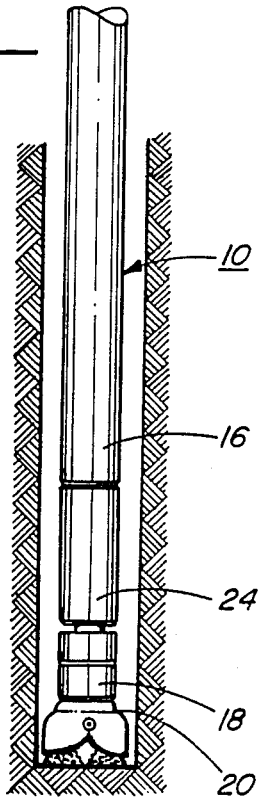
FIG. 3 is a view similar to that of FIG. 2 but additionally incorporating a form of shock tool located immediately below the flow pulsing apparatus.

FIG. 3 is a view very similar to that of FIG. 2 and like components have been identified with the same reference numbers as have been used in FIG. 2. However, it will be seen from FIG. 3 that, interposed between the flow pulsing apparatus 16, and the lower connecting sub 18, is a shock tool 24. As will be described in further detail hereafter, this shock tool is arranged to respond to the fluctuating or pulsing fluid flow being emitted from flow pulsing apparatus 16 thereby to cause vibration or oscillation of the drill bit 20 in the direction of the drill string axis thereby to further enhance the efficiency of the drilling operation.

Referring now to FIGS. 5, 6 and 7, the flow pulsing apparatus 16 is shown in detail. Apparatus 16 includes an external tubular housing 26, the wall of which is sufficiently thick as to withstand the torsional and axial forces applied thereto during the course of the drilling operation. Housing 26 is in two sections which are connected together via tapered screw threaded portion 28, with the upper end of the housing having a tapered internally threaded portion 30 adapted for connection to a lower end portion of the drill string. The housing 26 also includes a tapered internally threaded section 31 which may be connected to the drill bit 20 or, alternatively, by the use of a short connecting sub, not shown, threaded into the upper end of the shock tool 24 illustrated in FIG. 3.

Housing 26 may advantageously incorporate an integral blade stabilizer or reamer, the lobes 27 of which are shown in phantom in FIGS. 5 and 6. This enables the IBS or reamer to be placed close to the bit without requiring extra lengths of tool sections which would tend to reduce somewhat or attenuate the pulsing flow and thus reduce the efficiency of the device.

The housing 26 has a removable cartridge 32 located therein, cartridge 32 containing the turbine and valve means to be hereafter described. For purposes of this disclosure, the cartridge shell, which includes end portions 34, 36 may be considered as part of the housing means. Cartridge shell portions 34, 36 are screwed on to the opposing ends of a hollow metal intermediate section 38. The upstream portion 34 includes an axially arranged nose portion 40 of outwardly stepped conical and cylindrical shapes centered in the flow passage 42 along which the drilling fluid moves after having passed through a screen section 44 which removes large particles ($\frac{1}{8}''$–$\frac{1}{4}''$ diameter) from the drill fluid. Screen section 44 is described in more detail in copending application Ser. No. 008963 filed Jan. 30, 1987 and the disclosure is hereby incorporated by reference to it.

Upstream nose portion 40 is held in position by a series of radial supports 46(FIG. 6) extending between such nose portion 40 and shell portion 34.

A turbine 50 having helically curved vanes 51 to which the fluid applies torque in known fashion and an elongated rotor 52 is supported at its upstream end in the nose portion 40 and at its downstream end by a turbine stator assembly 54. Stator assembly 54 includes a plurality of radial vanes 56 fixed to cartridge shell and which support stator hub 58 axially in the center of the fluid flow path.

Turbine rotor 52 includes a reduced diameter upstream portion 60 and it is about this portion 60 that an annular valve member 62 of tungsten carbide is located for reciprocation along the axis of turbine rotation. Valve member 62 co-operates with an annular valve ring 64 which is mounted in an annular recess provided in shell intermediate section 38 and held in place by a truncated conical entry ring 65 which bears against a shallow step provided in the shell portion 34. Valve member 62 has a reduced diameter portion 66 defining a throat, and a sharply defined annular shoulder 68. An annular flow passage is defined between ring 64 and annular shoulder 68, which passage varies in area from a maximum to a minimum as the valve member 62 reciprocates.

The nose portion 40 includes a top bearing holder 70 which supports a bearing sleeve 72 made of tungsten carbide. Bearing sleeve 72 receives a short stub shaft 74, also of tungsten carbide, stub shaft 74 being in a force fit relation with the upstream end of turbine rotor portion 60. The downstream end of turbine rotor 52 also receives a tungsten carbide bearing sleeve 76 therein in force fit relation, which sleeve 76 receives a short stub shaft 78, the latter being in press fit relation to a bearing holder 80 mounted in the turbine stator assembly 54. A substantial degree of radial clearance, e.g. 0.020 to 0.050 inch, is provided between the stub shafts 74, 78 and their associated bearing sleeves so that the turbine rotor is free to vibrate laterally during operation. Further, since no seals are provided, the drilling fluid is free to circulate in these relatively loose sleeve bearings. This action sweeps away gritty particles which might otherwise accumulate in the bearings and cause rapid wear. A relatively long bearing life has been achieved in this fashion. The lower stub shaft 78 also has a domed end 79 which makes almost point contact with the end of bearing sleeve 76 thus assuring low rotational drag.

The above-noted top bearing holder 70 also supports about its outer circumference, an elongated valve support sleeve 82 of tungsten carbide. Sleeve 82 is suitably keyed to the bearing holder 70 and sealed thereto with O-ring seals. The upper end of annular valve member 62 is embraced by the sleeve 82 in a relatively loose fitting fashion, e.g. with a radial clearance of 0.020 to 0.050 inch to reduce the chances of binding due to the presence of grit between the contacting surfaces. Valve member 62 is restrained against rotation by means of an axially extending key 84 (FIG. 6) fixed to bearing holder 70 and which loosely enters a slot defined in the upper end of the valve member 62.

In order to effect reciprocation of valve member 62 on rotation of the turbine 50, the downstream end of the valve member 62 is provided with a cam surface 86. Cam surface 86 is in the form of an annulus surrounding the axis of turbine rotation. The cam shape will be described later, it being noted here that it provides valve opening and closing ramps, as well as dwell sections at the valve open and valve restricted positions. In the valve restricted position there is still enough flow as to allow the turbine 50 to move away from the stalled position.

The turbine rotor includes a laterally projecting finger which acts as a cam follower 90 as it engages annular cam surface 86. Since the valve member 62 cannot rotate, it must reciprocate along the axis of rotation with its support sleeve 82 if the cam follower 90 is to remain in contact with the cam surface 86. This contact is normally assured by two things, namely gravity, which acts on the valve member 62, and fluid drag forces which act on the surface of valve member 62. At the same time, if a large piece of debris should hold the valve open momentarily, no damage occurs as the camming surfaces merely separate until the obstacle has been flushed away.

The use of the single cam follower finger 90 confers a special benefit in the sense that it applies a non-symmetrical force to the valve member 62 which tends to make it rock slightly about an axis transverse to the reciprocation axis. This tends to provide a self-cleaning effect, reducing the possibility of grit causing jamming of the valve member 62 in the support sleeve 82. However, the use of the single finger follower arrangement is not mandatory and in FIG. 8 there is shown an identical valve arrangement except that a symmetrical two-finger cam follower 91 is shown in contact with the annular cam surface 86. The vibratory cleaning effect is not present but by using two followers, there is somewhat greater design flexibility in terms of selecting the vibrational frequency in terms of rate of turbine rotation.

It should also be noted that the valve member 62 and turbine 50 are both hydraulically neutral with hydraulic pressure forces thereon balancing and cancelling each other out. Concerning valve member 62 it will be noted that the drilling fluid has free access to the interior of the member, between itself and the turbine rotor and hence the fluid pressures can act on it in all directions. By avoiding significant hydraulic loadings, the contact forces at the bearings and cam surfaces are kept to relatively low levels thus reducing wear and helping to provide long equipment life.

An alternate embodiment of the invention is shown in FIG. 9. As before, the cartridge 100 is in three sections 102, 104 and 106. The upstream cartridge section 102 is provided with radial ribs 108 as before which support a central nose portion 110. The nose portion 110 leads into an enlarged central hub 112 having an enlarged central cavity 114 on its downstream end.

A rotor 118 extends along the axis of the cartridge as before, turbine 116 including an elongated rotor 118 to which is mounted a series of helical turbine blades which respond to flow of drilling fluid by exerting torque on the rotor 118. The downstream end of turbine rotor is journalled in a central hub assembly 120 which is secured by radial ribs 122. Hub assembly includes a tungsten carbide stub shaft 124 which enters into a tungsten carbide bearing sleeve 126 secured in the downstream end of the rotor in a loose fit unsealed arrangement as before.

The downstream end of rotor 118 is provided with an enlarged portion 125 which serves to carry a pair of diametrically opposed cam follower pins 128 both of tungsten carbide and secured to rotor 118 by suitable retaining means. Follower pins 128 make contact with an annular cam ring 130 which surrounds the axis of rotation and which cam ring is non-rotatably mounted in an annular recess on hub assembly 120. An annular body 132 of shock absorbing material reduces shock loadings.

The upstream end of tubine rotor 118 is located within the central cavity 114 on the downstream end of hub 112. Cavity 114 is provided with a tungsten carbide valve bushing 136 held in place with retaining screws and sealed to hub 112 by suitable O-ring seals. A sleeve-like cylindrical valve member 138 also of tungsten carbide is mounted to the upstream end of the turbine rotor 118 and fixed thereto by retaining nuts 140. This valve member 138 is slidably and rotatably disposed in valve bushing 136. Hence, as the turbine is rotated by a flow of drilling fluid, the cam action will cause the entire turbine together with valve member 138 to reciprocate axially up and down.

As with the previous embodiment, the central cartridge section is provided with an annular valve ring 142 such that an annular flow passage is defined between itself and the annular shoulder 144 defined by the valve member 138 the area of which passage goes from a maximum to a minimum to cause the flow to pulse as the turbine together with the valve member both rotates and reciprocates during operation. As before, the arrangement is such that the valve never closes completely as there must be at least some flow to avoid a stalled turbine condition.

The annular cam ring 130 is shown in plan in FIG. 10. Regions 146 correspond to the down, valve restricted position; ramps 148 correspond to the opening of the valve and in regions 150 the valve is full open. Ramps 152 cause the valve to descend to the restricted condition again.

FIG. 13 is a graph of the pressure above the restricting valve plotted against time. $T_{cl}$ represents closure time while $T_r$ represents the time the valve is restricted. $T_{op}$ represents the time to open the valve while $T_o$ represents the time the valve is open. The full cycle time is the sum of $T_{cl}+T_r+T_{op}+T_o$. For best results To should be equal to or slightly greater than the sum of the remaining times, i.e.

$$T_o \geqq (T_{cl}+T_r+T_{op}).$$

In FIG. 14 the cam design is represented. A change in ramp angle A will change $T_{cl}$ while a change in ramp angle B will change $T_{op}$. These angles, and the dwell sections on the cam $T_r$ and $T_o$ are preferably selected to satisfy the timing relationship suggested above.

During operation the pulsating pressurized flow being applied to the cleaning nozzles or jets of the drill bit provides greater turbulence and greater chip cleaning effect than was hitherto possible thus increasing the drilling rate in harder formation. In softer formations where the eroding action of the drill bit jets has a significant effect, the pulsating, high turbulence action also has a beneficial effect on drilling rate. By making use of the water hammer effect, these high peak pressures are attained without the need for applying additional pumping pressure at the surface thus meaning that standard pumping pressures can be used while at the same time achieving much higher than normal maximum flow velocities and pressures at the drill bit nozzles.

In the embodiments described above, owing to the water hammer effect created as a result of the pulsating flow of drilling fluid, mechanical vibrating forces will be applied to the flow pulsing apparatus which will act in the direction of the drill string axis, which pulsing or vibrating action will be transmitted to the drill bit. This pulsating mechanical force on the drill bit complements the pulsating flow being emitted from the drill bit jet nozzles thereby to further enhance the effectiveness of the drilling operation, i.e. to increase the drilling rate.

The above-described mechanical pulsing action can be further enhanced by the use of the apparatus illustrated in FIG. 12. In FIG. 12 a form of shock tool 160 is connected via the usual tapered screw threads 162 to the lower end, i.e. the outlet end of the flow pulsing apparatus 16. The shock tool 160 includes an outer casing portion 164, within which is slidably located an elongated mandrel 166. The lower end of mandrel 166 has an internally threaded section 168 which allows the same to be connected to the drill bit 20 either directly or by way of a short sub-section.

Suitable annular seals 172 and 170 are provided between the housing 164 and the upper and lower ends of the mandrel 166 thereby to assist in preventing contaminants from entering between these two components and hindering their relative axial movement. The upstream and downstream ends of mandrel 166 are provided with a collar portion 174 and ledge 176 and these provide annular steps against which the upper and lower ends of a spring stack 178 alternately engage during operation. The lower and upper ends of spring stack 178 rest against shoulders 180, 182 respectively, fixed relative to housing 164. This spring stack 178 is conveniently comprised of a plurality of annular belleville-type washers although any suitable compression spring means may be provided.

It will be seen by reference to FIG. 12 that the upper end of the mandrel, as well as the central passageway through the mandrel, which is filled with pressurized drilling fluid during use, in effect defines an open area piston. During operation there is of course a pressure differential between the pressure of the drilling fluid within the mandrel and the pressure of the drilling fluid which is outside of the shock tool 160 altogether, namely, the drilling fluid which is returning upwardly between the tool and the wall of the well bore. By virtue of the fact that the drilling fluid leaving the flow pulsing apparatus 16 is pulsating at a predetermined frequency as noted above, this pressure differential also is varying accordingly and as this pulsating differential pressure acts on the open area piston noted above, it serves to extend the mandrel 166 relative to the housing 164 with the result being that the shock tool 160 effectively performs as a "mud hammer". Those skilled in this field will appreciate that for this action to take place the drill bit weight should be reduced by lifting up on the drill string so that the latter does not apply any appreciable downward force to the bit. This hammering effect is of course directly transmitted to the drill bit 20. Again, the drilling fluid leaving the jet openings 22 in the drill bit 20 will be subject to the pressure fluctuations described above and will exhibit the desired enhanced hydraulic effect. The shock tool 160, behaving as a "mud hammer" applies a strong pulsing or vibrating action to the drill bit thus causing it to drill more effectively. At the same time, it should be realized that the peak loadings applied to the drill bit are somewhat less than in the case of a conventional mud hammer in that, owing to the hydraulic action involved, the pressure peaks are somewhat rounded or curved. These curved peaks effectively do less damage to the drill bit at higher loadings thus resulting in a longer bit life.

The use of the shock tool 160 as shown in FIG. 12, is optional and under many drilling conditions its use is unnecessary.

Although the invention is not to be strictly limited to any particular mathematical relationship or theory of operation, the following relationships may be useful to those skilled in this art.

RATIO OF RESTRICTION

It was noted before that the reciprocating valve permits a relatively high degree or ratio of restriction of the flow to take place and consequently it can provide a large water hammer effect. It can be shown that the following relationship should be observed if an adequate water hammer effect is to be achieved (neglecting drill string elasticity):

$$A_r \leqq A_o \sqrt{\frac{H_o}{pW_cW}}$$

where:

$A_o$ = area open to flow at the entry into the full open valve. This area is designed in accordance with allowable space including outside diameter of tool and mechanical strength of the tool joint ($m^2$).

$A_r$ = area of the flow passage at full restriction of the valve member, i.e. the valve member in the lowest position ($m^2$).

$W_c$ = velocity of a pressure wave (sound) in drill fluid (e.g. 1220 m/sec.)

W = velocity of the flow of drilling fluid through the drill collars above the flow pulsing apparatus (m/s).

p = specific mass of drilling fluid, i.e. the density ($kg/m^3$) divided by the acceleration of gravity ($m/s^2$).

$H_o$ = pressure head across the open valve ($kg/m^2$).

FREQUENCY BOUNDARIES (Low Frequency)

In order to avoid a frequency that would resonate with the natural frequency of the drill collar section of the drill string the following observations apply:

(a) For a bottom hole assembly (BHA) without the shock tool: min frequency (f) of flow pulsing 4212/L cycles/sec * L=length of the drill collar section * based on speed of compression wave in steel of 16850 ft/sec.

(b) For bottom hole assembly (BHA) including a shock tool (e.g. as described above):

$$\text{min frequency } (f) \text{ of flow pulsing} > \frac{1}{2\pi}\sqrt{\frac{K_{st}}{M}}\ *$$

where:

$K_{st}$=spring constant of shock tool.

M=total mass of bottom hole assembly (slugs).

* Reference SPE Journal Article #11228, Don W. Dareling, "Drill Collar Length is a major factor in Vibration Control".

FREQUENCY BOUNDARIES (high Frequence)

The limit on high frequency requires a brief review of the operation of the valve.

(a) when valve is fully open ($A_o$) - the pressure above and below the valve is equal to a nominal pressure.

(b) valve starts to close, then becomes fully restricted and thereafter starts to open ($A_r$) - Pressure above valve=$H_r$ (head across restricted valve)+nominal pressure. Pressure below valve=nominal pressure $-H_r$.

(c) valve opens - high pressure above valve is released and pressure pulse moves down through valve ($A_o$).

During that portion of the cycle (b) as described above, the net downward force on the (BHA) bottom hole assembly is increased from the normal. It is necessary that the drill bit descend during that time interval in order to function efficiently. The time that it takes the drill bit to descend is proportional to the rate of penetration (ROP) and to the acceleration of the drill bit.($A_{db}$). $A_{db}$ follows Newton's second law and equals the sum of all forces acting on the bottom hole assembly divided by the mass of the bottom hole assembly.

It can be shown that the time for the drill bit (or BHA) to descend is given by the following:

$$T_{bha} = \sqrt{\frac{2D}{A_{db}}}$$

where D=amount of descent/cycle (M) (related to rate of penetration)

as noted previously, in connection with the pressure cycle diagram $$T_o \geqq (T_{cl}+T_r+T_{op}) \text{ and}$$

$$T_o \geqq f/2$$

$$T_{bha} \geqq (T_{cl}+T_r+T_{op}) = f/2$$

from which it follows that $$f(\text{maximum}) \leqq 2 \times \sqrt{\frac{2D}{A_{db}}}$$

An examination of the graph of FIG. 15 will reveal some of the major advantages of the invention. The reciprocating valve member permits the restriction area $A_r$ to be made relatively small. By way of example, the rotary valve member described in my copending application filed Jan. 30th, 1987, by virtue of the required radial clearances and the required size of the valve ports, was not able to provide a restriction area of less than about 0.60 square inches. However, with the reciprocating valve of the present structure, the restriction area ($A_r$) can be made as small as desired just so long as sufficient flow can be provided as to move the turbine away from the stalled condition. The water hammer effect increases at a very high rate as the restriction area decreases, especially in the areas when the slopes of the curves have decreased and make shallow angles with the horizontal (pressure) axis. The effect is especially notable at low total flow rates. With previous rotary designs and a maximum permissible restriction of about 0.60 square inches, the water hammer effect only provides a pressure rise of about 100 psi at a flow rate of 230 gallon/minute. With an area restriction ($A_r$) of 0.20 square inches at the same flow rate, the pressure rise when the valve is restricted is over 1000 psi, a ten-fold difference. The effect is somewhat less dramatic at higher flow rates but in all cases the increase in water hammer effect coupled with the greater flow rates made possible by the larger valve open area ($A_o$) provide a very effective flow pulsing operation and enable higher drilling rates to be achieved than hitherto.

I claim:

1. Flow pulsing apparatus adapted to be connected in a drill string above a drill bit and including a housing providing a passage for a flow of drilling fluid toward the bit, turbine means in said housing rotated about an axis by the flow of drilling fluid, and valve means operated by said turbine means for periodically restricting the flow through said passage in a cyclical manner to create pulsations in said flow and a cyclical water hammer effect to vibrate the housing and the drill bit during use, said valve means including a valve member which is reciprocated in response to rotation of the turbine means to effect said periodic and cyclical restriction of the flow.

2. Apparatus according to claim 1 including cam means for effecting said reciprocation of said valve member in response to rotation of the turbine means.

3. Apparatus according to claim 2 wherein said cam means includes an annular cam surrounding said axis of rotation of the turbine means, and cam follower means engaging said annular cam, with relative rotation between said follower means and said cam occurring on rotation of said turbine means to effect the reciprocation of the valve member.

4. Apparatus according to claim 3 wherein said valve member is mounted for reciprocation along said axis of rotation of the turbine means, said axis of rotation, when said apparatus is located in a drill string, extending longitudinally of the drill string.

5. Apparatus according to claim 4 wherein said valve member is so arranged that, during use, it is bathed in drilling fluid so that the resulting hydraulic pressure forces on said valve member substantially balance and cancel each other out.

6. Apparatus according to claim 5 wherein said turbine means is arranged in said casing in relation to said valve means such that, during use, said turbine means is fully bathed in drilling fluid at the same pressure throughout and is substantially hydraulically neutral so that the resulting pressure forces on the turbine means substantially cancel each other.

7. Apparatus according to claim 4 wherein said valve means further includes an annular ring fixed to said housing and surrounding said axis of rotation, said valve member being arranged such that an annular flow passage is defined between itself and said ring, said valve member being mounted for reciprocation toward and away from said annular ring such that the area of the annular flow passage defined between said ring and valve member varies from a maximum to a minimum.

8. Apparatus according to claim 4 wherein said turbine means and said valve member are fixed together for both rotary and reciprocating motion.

9. Apparatus according to claim 8 wherein said valve means includes an annular ring fixed to said housing, said turbine means including an elongated rotor, said valve member including an annular body fixed to a portion of said rotor so that during axial reciprocation of the rotor the annular body of the valve member moves toward and away from said ring to vary the area of the annular flow passage defined between them from a maximum to a minimum.

10. Apparatus according to claim 9 including sleeve bearing means supporting said rotor for said rotary and reciprocating motions, said rotor being arranged so that in use in a drill string, gravitational and fluid flow drag forces maintain said cam in contact with the follower means.

11. Apparatus according to claim 4 wherein said reciprocal valve member is secured against rotation, said annular cam and said cam follower means being arranged to interact between said turbine means and said valve member to effect reciprocation of the latter on rotation of said turbine means.

12. Apparatus according to claim 11 wherein said valve means includes an annular ring fixed in the passage defined by said housing and surrounding said axis of rotation of the turbine means, said valve member comprising an annular body surrounding said axis of rotation such that an annular flow passage is defined between the valve member and said ring, and guide means constraining said valve member for reciprocation along said axis relative to said ring so that the area of the annular flow passage varies from a maximum to a minimum to effect the pulsations in the flow.

13. Apparatus according to claim 12 wherein said valve member has a reduced diameter portion defining a throat and an annular shoulder, said variable size annular flow passage being defined between said fixed ring and said annular shoulder.

14. Apparatus according to claim 13 wherein said annular cam is located at a downstream end face of sid annular body of the valve member so that in use gravitational and fluid flow drag forces assist in maintaining contact between said cam and said cam follower means, and said cam follower means secured to said turbine means and engaging the annular cam, said valve member being loosely supported by said guide means so that it is free to vibrate relative thereto to assist in clearing away particles in the drill fluid which might tend to bind the valve member.

15. Apparatus according to claim 14 wherein said cam follower is arranged to apply a non-symmetrical force to said annular cam to induce vibration of the valve member about an axis transverse to the axis of reciprocation.

16. Apparatus according to claim 15 wherein said cam follower comprises a single finger secured to said turbine means and engaging the annular cam at a point located outwardly of the axis of rotation.

17. Apparatus according to claim 14 wherein said cam follower is arranged to supply a symmetrical force to said annular cam, said follower comprising a pair of diametrically opposed finger means.

18. Apparatus according to claim 14 wherein said guide means comprises an elongated sleeve which surrounds the axis of rotation and which also surrounds a substantial portion of said valve member to guide the latter along its path of reciprocation.

19. Apparatus according to claim 18 wherein said turbine means includes an elongated rotor section, and the valve member surrounding a portion of said rotor section, and relatively loose unsealed sleeve bearing means supporting said rotor section at opposite ends thereof with vibration of the rotor section during use inducing flow of drilling fluid through said loose sleeve bearing means to flush gritty material out of the bearings.

20. Flow pulsing apparatus according to claim 1 wherein reciprocation of said valve member causes the area of the passage for flow of drilling fluid to fluctuate between an open condition ($A_o$) and a restricted condition ($A_r$) and wherein the following relationship between ($A_r$) and ($A_o$) exists:

$$A_r \leqq A_o \sqrt{\frac{H_o}{pW_cW}}$$

where:

$A_o$=area open to flow at the entry into the full open valve ($m^2$);

$A_r$=area of the flow passage at full restriction of the valve member, i.e. the valve member in the lowest position ($m^2$);

$W_c$=velocity of a pressure wave (sound) in drill fluid;

W=velocity of the flow of drilling fluid through drill collars above the flow pulsing apparatus (m/s);

p=specific mass of drilling fluid, i.e. the density ($kg/m^3$) divided by the acceleration of gravity ($m/s^2$);

$H_o$=pressure head across the open valve ($kg/m^2$).

* * * * *